US005737987A

United States Patent [19]

Olson et al.

[11] Patent Number: 5,737,987

[45] Date of Patent: Apr. 14, 1998

[54] PLURAL MODE STACKING SYSTEM FOR SLIT SHEETS

[75] Inventors: Steven D. Olson, Rochester; Roger N. Albright, Fairport, both of N.Y.

[73] Assignee: Xerox Corporation, Stamford, Conn.

[21] Appl. No.: 667,560

[22] Filed: Jun. 21, 1996

[51] Int. Cl.[6] ..... B65H 31/20; B26D 1/12; G03G 15/00

[52] U.S. Cl. ..... 83/89; 83/27; 83/105; 83/167; 83/343; 83/425.3; 271/207; 271/213; 271/299; 399/405

[58] Field of Search ..... 83/86, 89, 102, 83/105, 27, 106, 167, 343, 345, 425.3; 271/207, 213, 279, 288, 299; 399/405, 407

[56] References Cited

U.S. PATENT DOCUMENTS

| | | | |
|---|---|---|---|
| 3,815,898 | 6/1974 | Haifley et al. | 271/207 X |
| 4,559,855 | 12/1985 | Schieck | 83/425.3 |
| 4,605,211 | 8/1986 | Sonobe | 271/213 X |
| 4,995,602 | 2/1991 | Nakadai et al. | 271/207 |
| 5,094,660 | 3/1992 | Okuzawa | 271/220 X |
| 5,434,660 | 7/1995 | Yoshida et al. | 271/207 X |
| 5,511,771 | 4/1996 | Rubscha | 271/207 X |
| 5,512,996 | 4/1996 | Fare | 271/207 X |

FOREIGN PATENT DOCUMENTS

| | | | |
|---|---|---|---|
| 3916039 | 11/1990 | Germany | 271/207 |
| 57-197563 | 12/1982 | Japan | 271/207 |
| 58-144045 | 8/1983 | Japan | 271/213 |
| 59-86546 | 5/1984 | Japan | 271/207 |
| 60-19640 | 1/1985 | Japan | 271/207 |
| 62-201768 | 9/1987 | Japan | 271/299 |
| 62-201769 | 9/1987 | Japan | 271/299 |
| 62-211267 | 9/1987 | Japan | 271/207 |
| 62-215464 | 9/1987 | Japan | 271/207 |
| 2-75566 | 3/1990 | Japan | 271/207 |
| 3-128856 | 5/1991 | Japan | 271/207 |
| 4-223965 | 8/1992 | Japan | 271/207 |
| 5-254709 | 10/1993 | Japan | 271/207 |
| 5-278924 | 10/1993 | Japan | 271/207 |
| 6-127786 | 5/1994 | Japan | 271/207 |

*Primary Examiner*—Clark F. Dexter

[57] ABSTRACT

In a reproduction system with an output sheet stacking tray system and a slitter with selectable sheet slitting positions in which printed sheets being outputted by the reproduction system may be selectably slit (or not) in their sheet output direction into plural slit sheets of selectably variable sheet widths and stacked in the output tray sheet stacking system; a dual mode output sheet stacking tray system is selectably convertible between a single sheet stacking position mode and a plural slit sheet stacking surfaces mode, wherein in the plural slit sheet stacking surfaces mode the sheet stacking tray system provides plural opposingly transversely sloped sheet stacking surfaces with low friction to assist slit sheets slit from the same printed sheet to transversely slide laterally away from one another, wherein these opposingly sloped surfaces intersect substantially in line with the slitting position of the slitter in the process direction.

1 Claim, 14 Drawing Sheets

PLURAL MODE STACKING SYSTEM FOR SLIT SHEETS

Disclosed in the embodiments herein is an improved output system for a reproduction system with an optional variable slitting system such that the printed sheets being outputted by the reproduction system can be outputted either unslit, or slit in their sheet output direction into plural slit sheets of selectably variable sheet widths. Also disclosed is a dual mode output sheet stacking tray system which can alternatively provide separate stacking of plural slit sheets, or common stacking of unslit sheets.

A reproduction system with an output slitter is desirable in various situations in which it is desired to provide small size printed sheets as an output without the difficulty or impossibility of running such small sheets through the printing system. Instead, a sheet slitter can be used to cut normal size or larger, easier to print, sheets into desired smaller sizes just prior to their output into a stacking tray. Such known slitting systems can also be used to effectively multiply printing speed or productivity by simultaneously printing separate images on separate areas of a conventional size sheet in the reproduction apparatus, and then slitting them into separate sheets in the output with the slitter.

The disclosed system can be implemented as a low cost and simple system which can automatically correctly stack the; small sheets of paper that are produced when larger sheets are slit, into discretely laterally separated stacks.

The disclosed embodiment can provide a single set stacking position for unslit sheets on a single stacking surface, or, alternatively, proper plural sets stacking of cut sheets by providing trays with two or more opposing inverted "V" slanted sheet guiding surfaces with the surfaces separating at the slitting position, along the process direction, as further described and illustrated herein.

The disclosed system can be used with a variety of different output sheet slitters. The particular example disclosed herein is the variable slitting position output slitter of Xerox Corporation U.S. Pat. No. 4,559,855 issued Dec. 24, 1985 to Richard A. Schieck. Various other output sheet slitters, particularly suited for the output of xerographic or other copiers or printers are cited in the introduction of said U.S. Pat. No. 4,559,855 and need not be repeated herein.

In reproduction apparatus such as xerographic and other copiers and printers or multifunction machines, it is increasingly important to provide faster yet more reliable and more automatic handling of the physical image bearing sheets. A specific feature of the specific embodiments disclosed herein is to provide, in an output system having an output sheet stacking tray system and a slitter with selectable sheet slitting positions in which printed sheets being outputted by said reproduction system into said output system are selectably unslit or slit in their sheet output direction by said slitter into plural slit sheets of selectably variable sheet widths and stacked in said output tray sheet stacking system; the improvement comprising a dual mode output sheet stacking tray system selectably convertible between a single sheet stacking position surface mode and a plural slit sheet stacking surfaces mode, wherein in said plural slit sheet stacking surfaces mode said sheet stacking tray system provides plural sheet stacking surfaces, which are selectably variable in coordination with said selectable sheet slitting position slitter to provide separate stacking of said plural slit sheets on respective said plural sheet stacking surfaces.

Further specific features disclosed herein, individually or in combination, include those wherein said plural variable area sheet stacking surfaces are combinable into a single common surface to provide said single sheet stacking surface mode for stacking unslit sheets; and/or wherein said plural variable area size sheet stacking surfaces are opposingly transversely sloped; and/or wherein said plural variable area sheet stacking surfaces are combinable into a single common surface to provide said single sheet stacking surface mode for stacking unslit sheets; and/or wherein said plural variable area sheet stacking surfaces have low friction surfaces to assist said slit sheets slit from the same printed sheet to slide laterally away from one another to provide lateral sliding separation of said slit sheets; and/or wherein said opposingly sloped surfaces intersect substantially in line with said slitting position of said slitter; and/or wherein said plural variable area sheet stacking surfaces comprise integral portions of a roof-shaped tray stacking surface having a repositionable roof ridge line extending in said sheet output direction from said resettable slitting position of said slitter; and/or wherein said roof-shaped tray stacking surface is flexible, and wherein an elevated bail bar extends under said roof-shaped tray surface in said sheet output direction to define said roof ridge line of said tray stacking surface, and wherein said bail bar is transversely resettable to align with said resettable slitting position of said slitter; and/or wherein said bail bar is alternatively resettable to one side of said output tray to define a single stacking surface for unslit sheets.

In the description herein the term "sheet" refers to a usually flimsy physical sheet of paper, plastic, or other suitable physical substrate for images, whether precut or web fed. A "copy sheet" may be abbreviated as a "copy", or called a "hardcopy". A "job" or "print job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

BRIEF DESCRIPTION OF THE DRAWINGS

Various of the above-mentioned and further features and advantages will be apparent from the specific apparatus and its operation described in the examples below, and the claims. Thus, the present invention will be better understood from this description of specific embodiments, including the drawing figures (approximately to scale) wherein:

DETAILED DESCRIPTION OF THE PREFERRED EMBODIMENTS

Turning now to the embodiments shown in the FIGURES, since, as noted, the operation and details of the variable position slitter illustrated in this example in FIGS. 1 through 4 is fully described in said U.S. Pat. No. 4,559,855, it need not be redescribed here.

Figure 1:
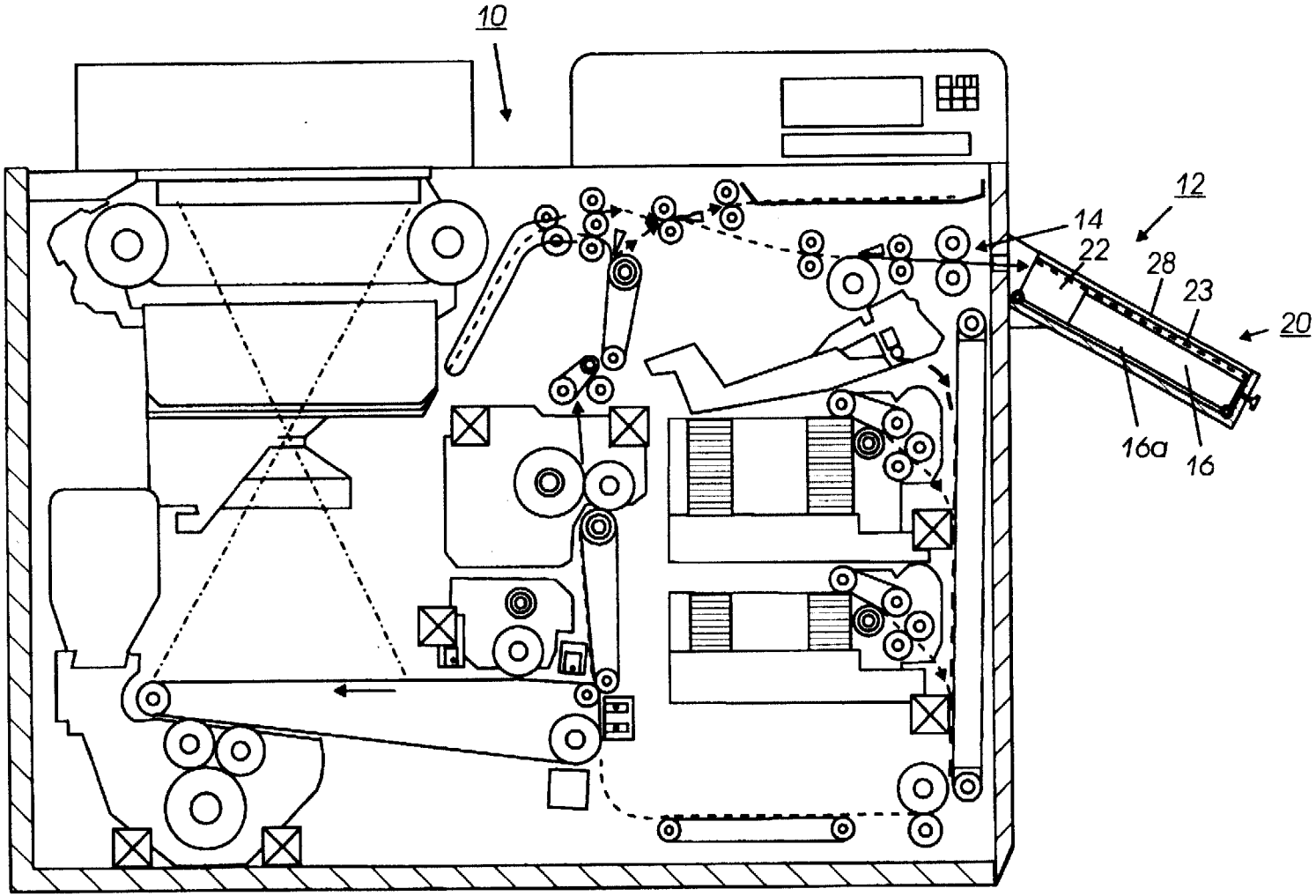
FIGS. 1, 2, 3 and 4 show the plural mode copy sheet output slitter of the above-cited U.S. Pat. No. 4,559,855 by way of an example of a reproduction system with a variable output slitter suitable for use in the present system, shown with an exemplary modification of the output tray system of the present invention in FIG. 1.
Figure 2:
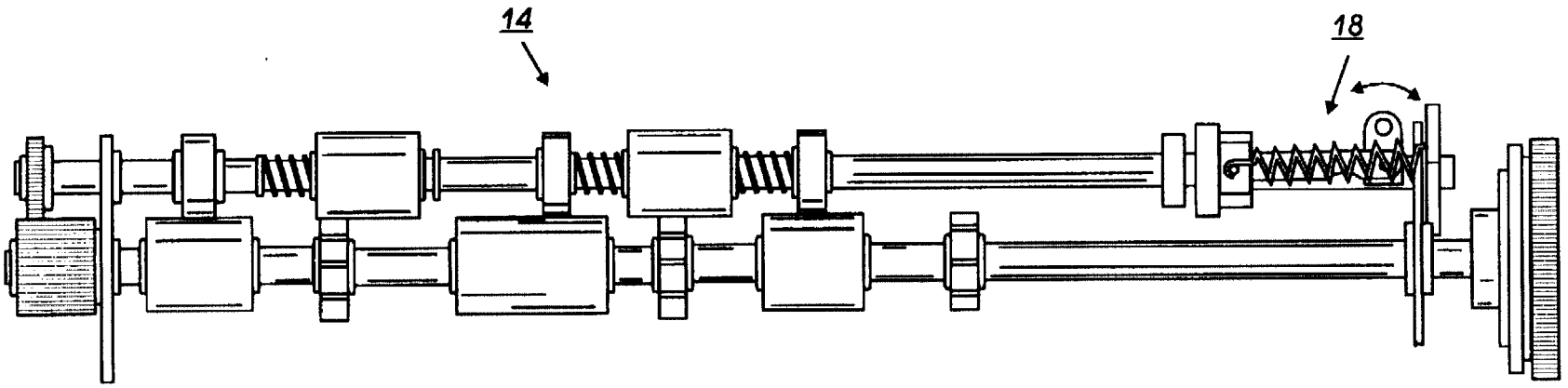
PRIOR ART FIG.2
Figure 3:
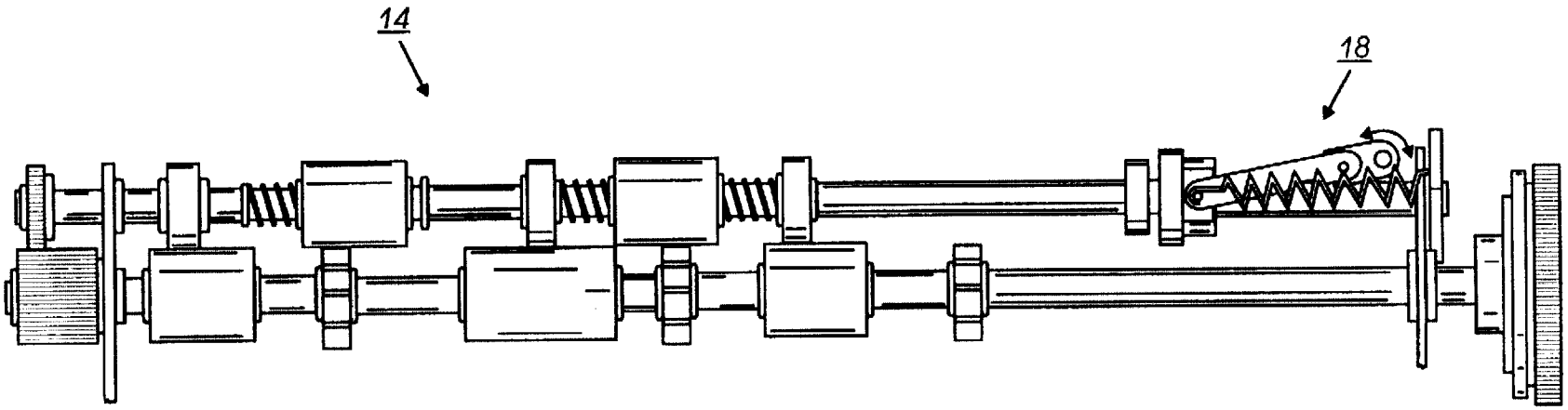
PRIOR ART FIG. 3
Figure 4:
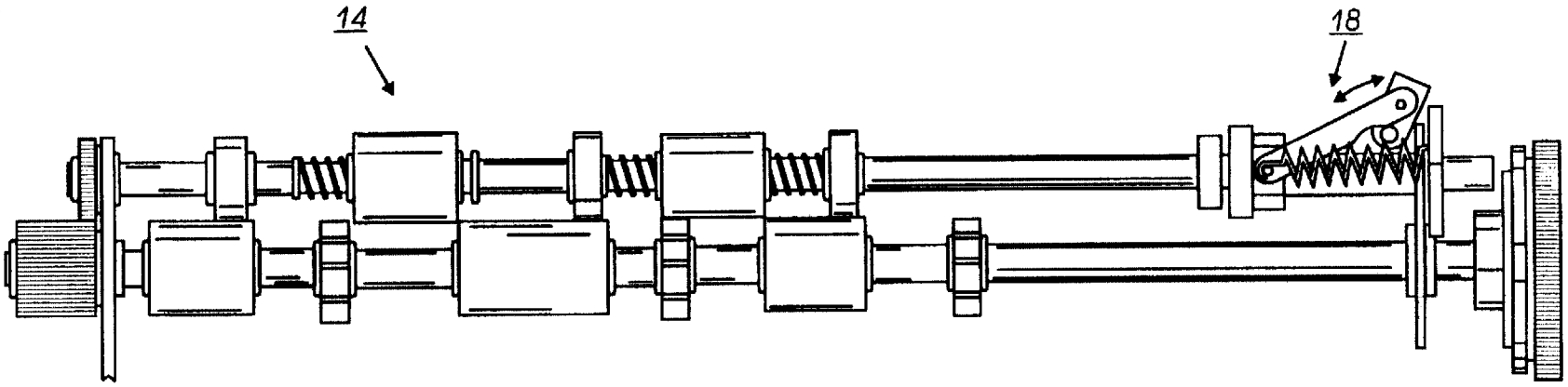
PRIOR ART FIG. 4

Briefly, a sheet processing system includes a reproduction system and an output system, wherein the reproduction system such as 10 in FIG. 1, of any desired type, provides printed sheets to the output system 12, including a slitter 14 as so illustrated and described. For example, as shown in perspective in FIG. 7, the printed sheets 16 may be slit into slit sheets 16*a* and 16*b* (two in this example). The number and size of the slit sheets may be selected, for example, by a slitting position selector such as 18, shown in FIGS. 2, 3, and 4. As shown in FIG. 2, this selector 18 may be set so as not to provide any slitting and therefore eject the sheets uncut in their original size for common stacking. Alternatively, as in FIG. 3, for example, the selector 18 may be set to provide a single slit at a single shearing position in the process direction by abutting shearing edge rollers as shown, to provide two slit sheets. As shown in FIG. 4, another position of the slitting position selector 18 can provide two or more slits of a sheet to provide three or more slit sheets simultaneously outputted into the stacking tray system.

Figure 5A:
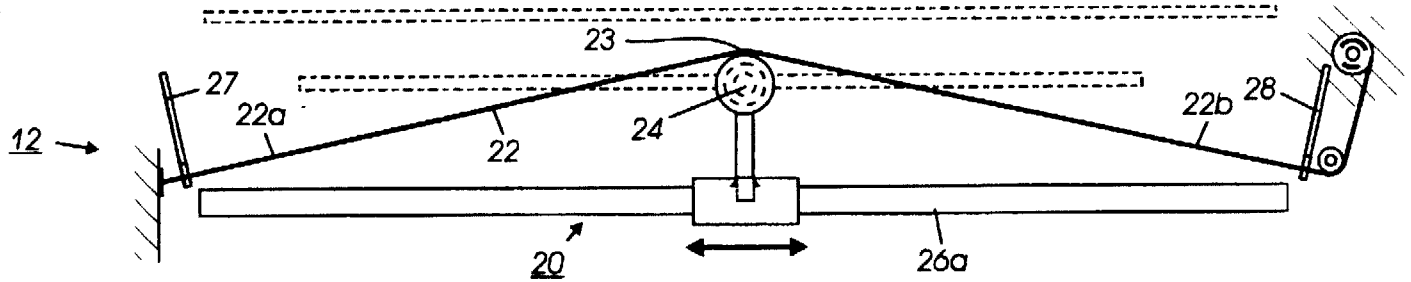
FIGS. 5*a*, 5*b*, and 5*c* illustrate a first embodiment of the output tray system per se as one example of the present system, shown in three different operating positions.
Figure 5B:
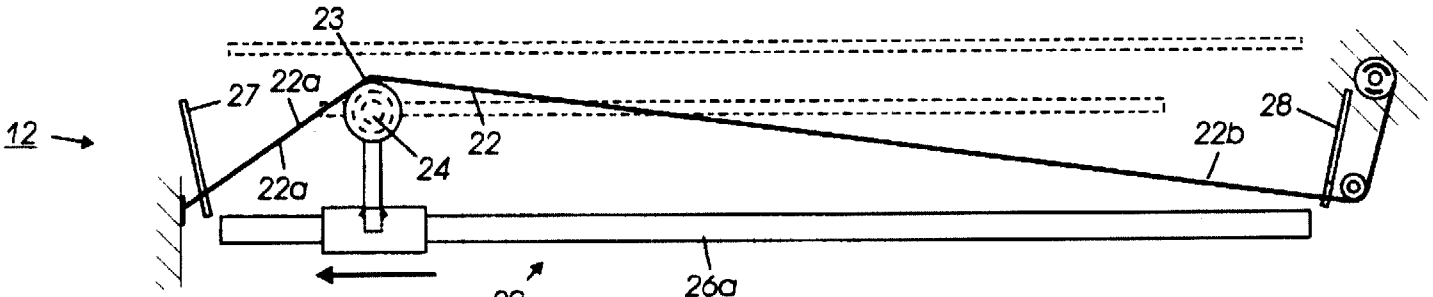
Figure 5C:
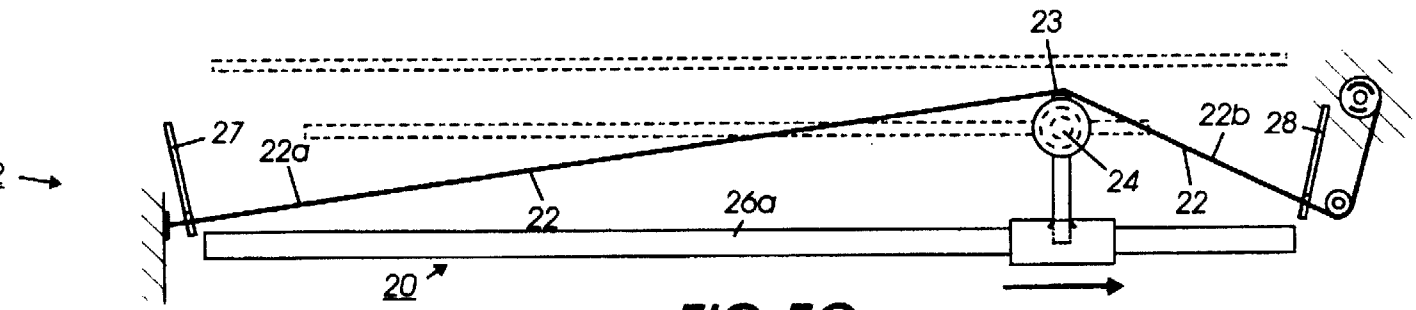
Figure 6:
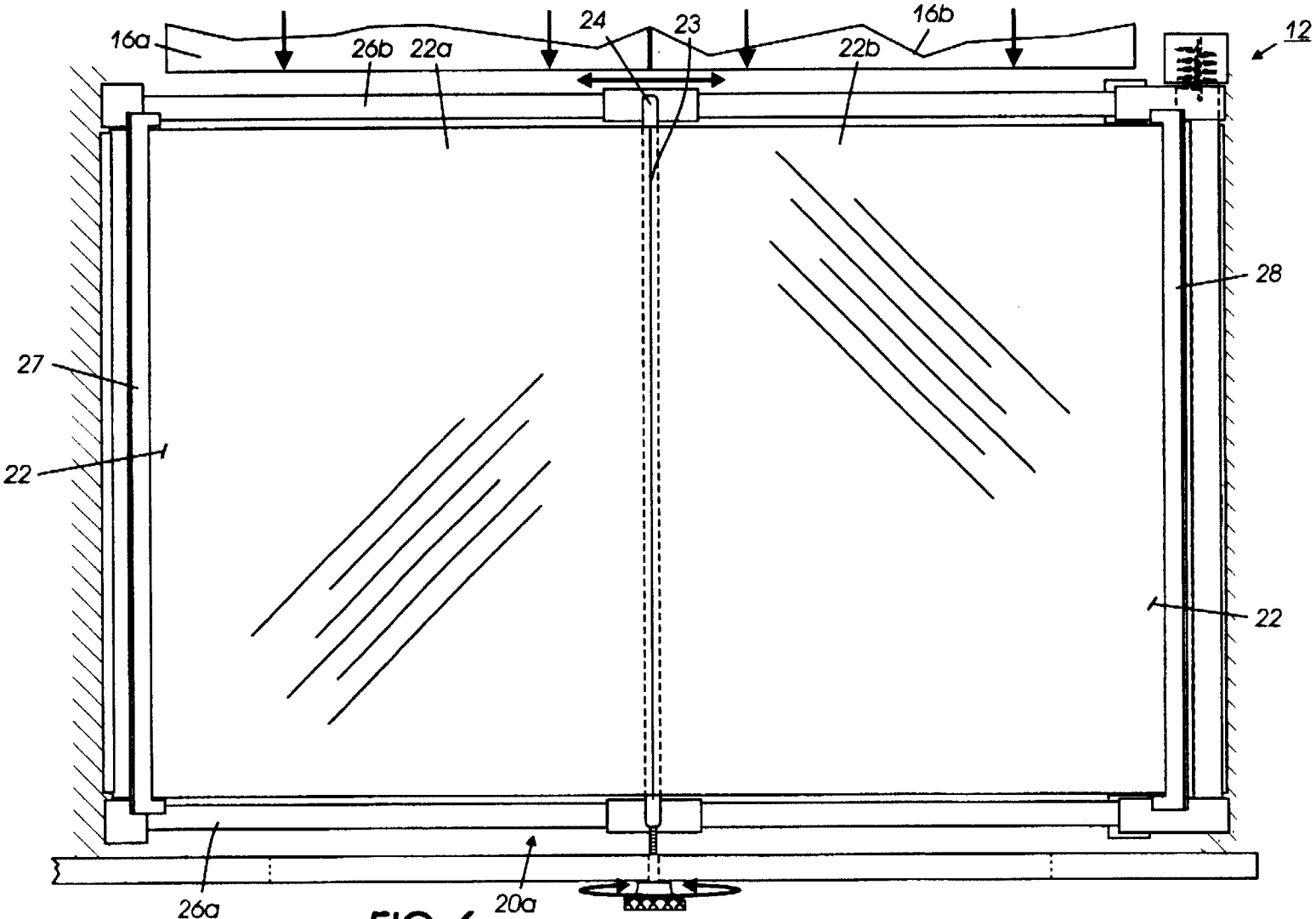
FIG. 6 is a top view of the multimode output tray system of FIG. 5.
Figure 7:
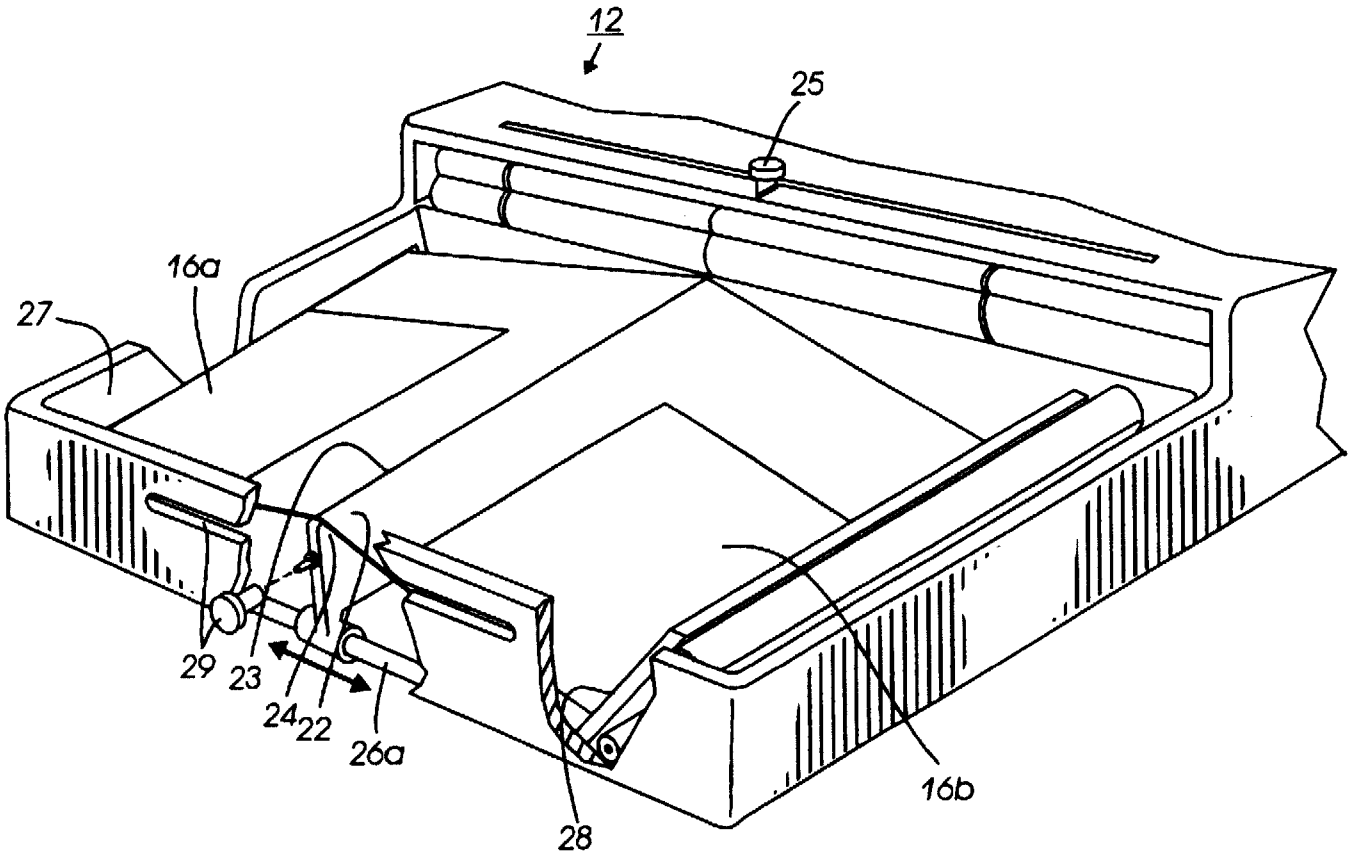
FIG. 7 is a perspective view of the output tray system of FIGS. 5 and 6 in one position.
Figure 8A:
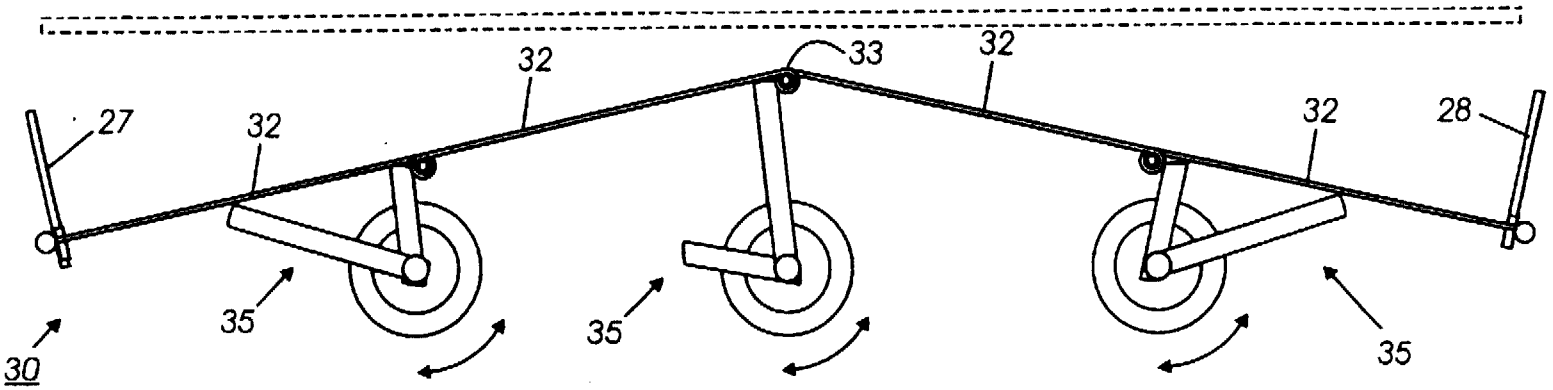
FIGS. 8*a*, 8*b*, 8*c*, and 8*d* illustrate four different operating positions of a second embodiment of the subject plural mode output sheet stacking tray system, in an end view.
Figure 8B:
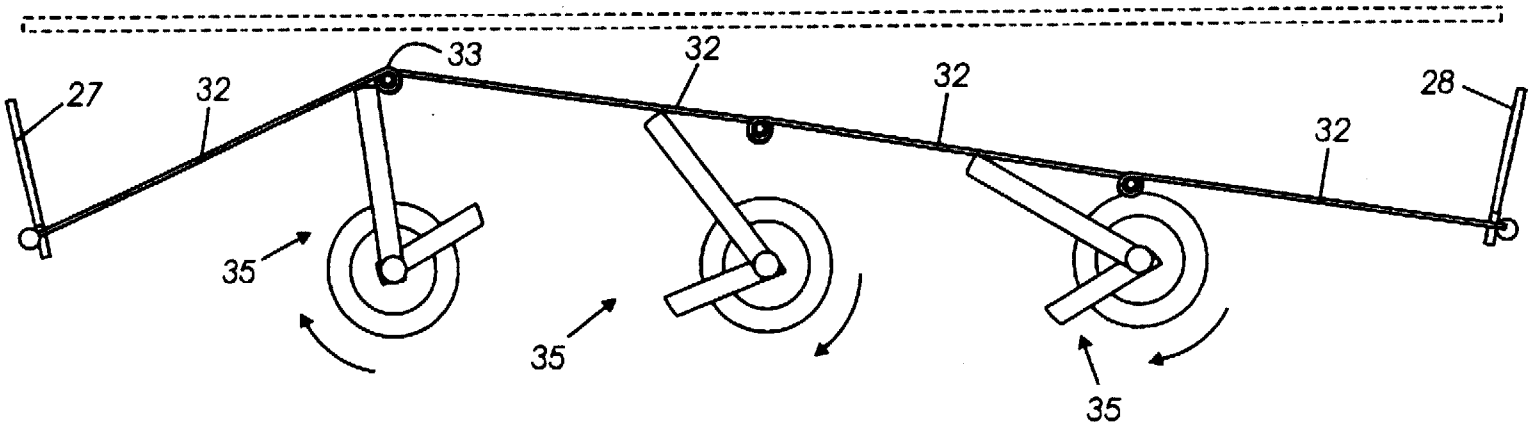
Figure 8C:
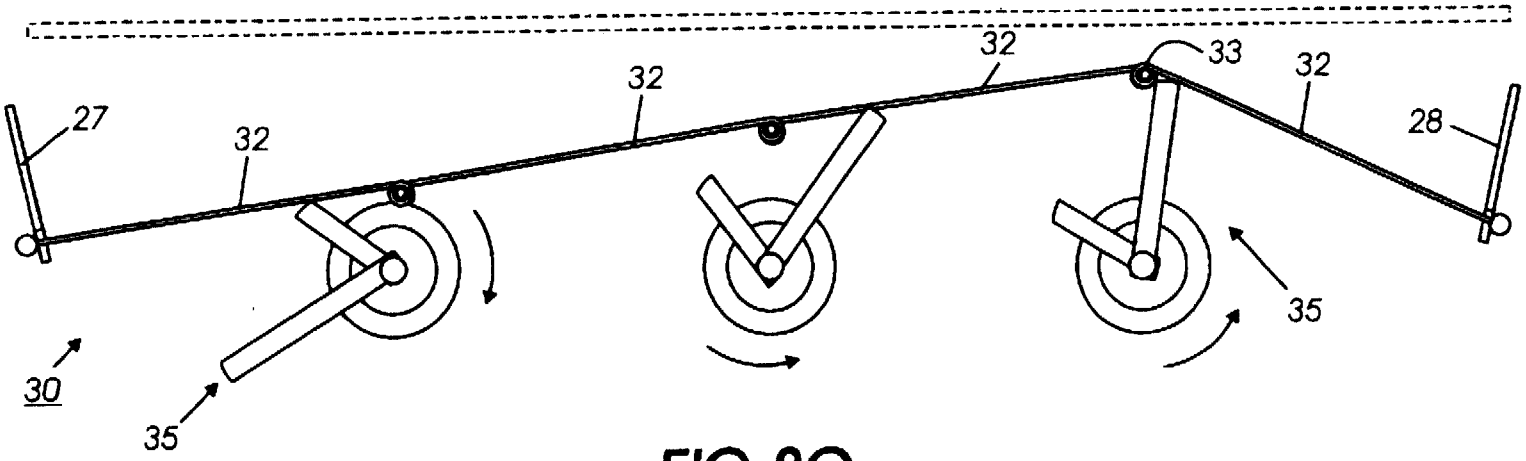
Figure 8D:
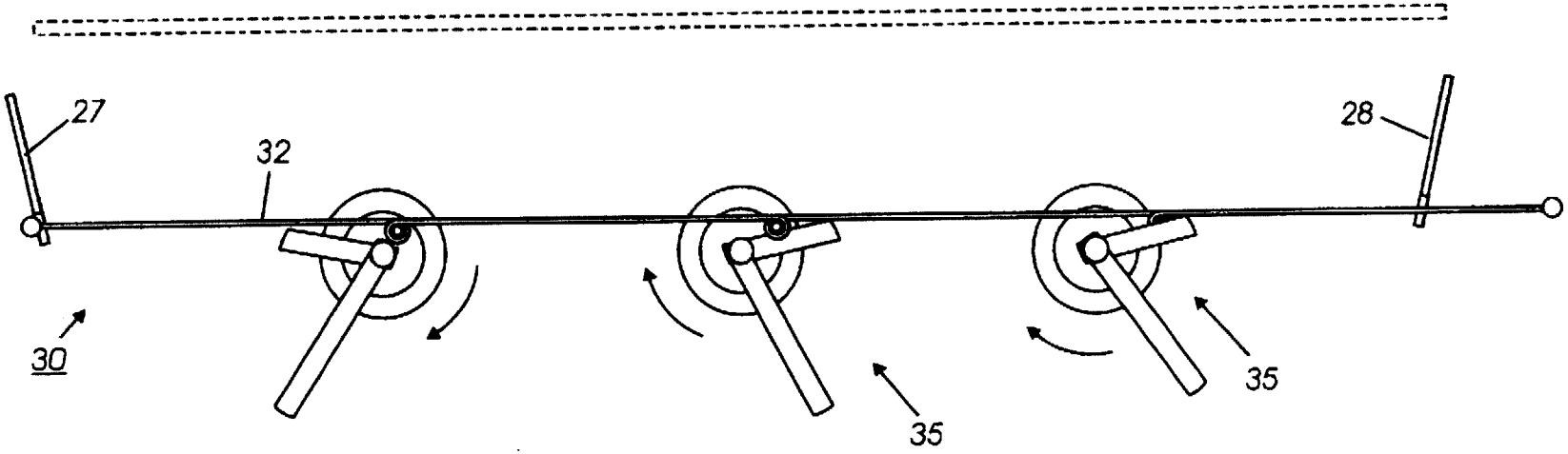
Figure 9:
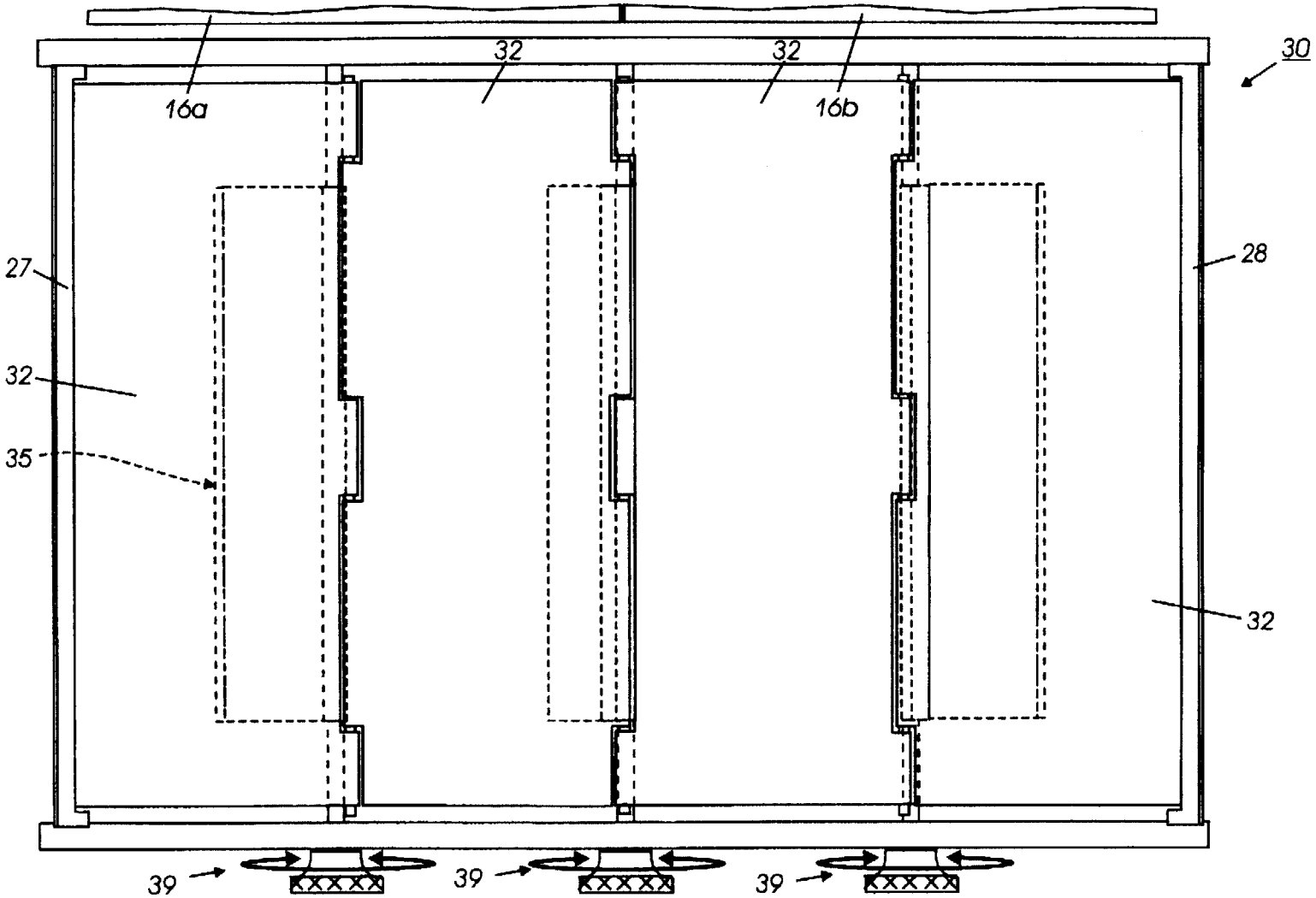
FIG. 9 is a top view of the embodiment of FIG. 8.
Figure 10A:
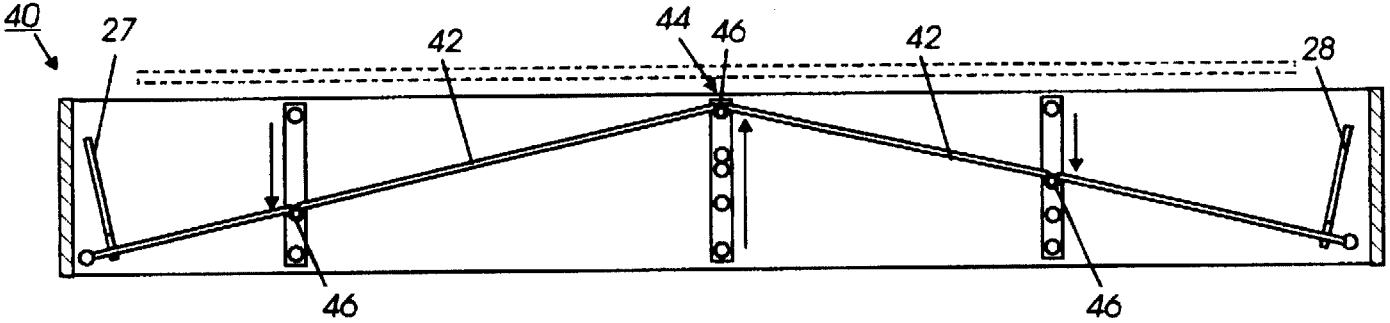
FIGS. 10*a*, 10*b*, 10*c*, and 10*d* illustrate four different operating positions of a third embodiment of the output stacking tray system in an end view.
Figure 10B:
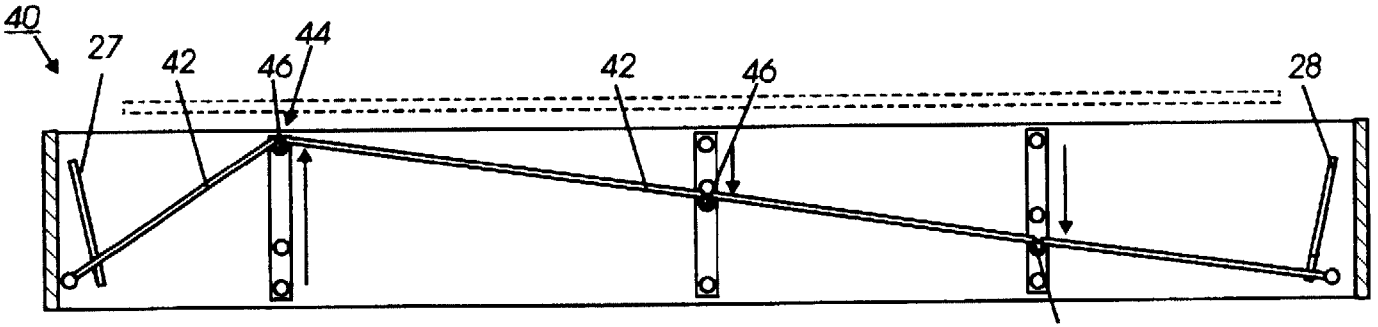
Figure 10C:
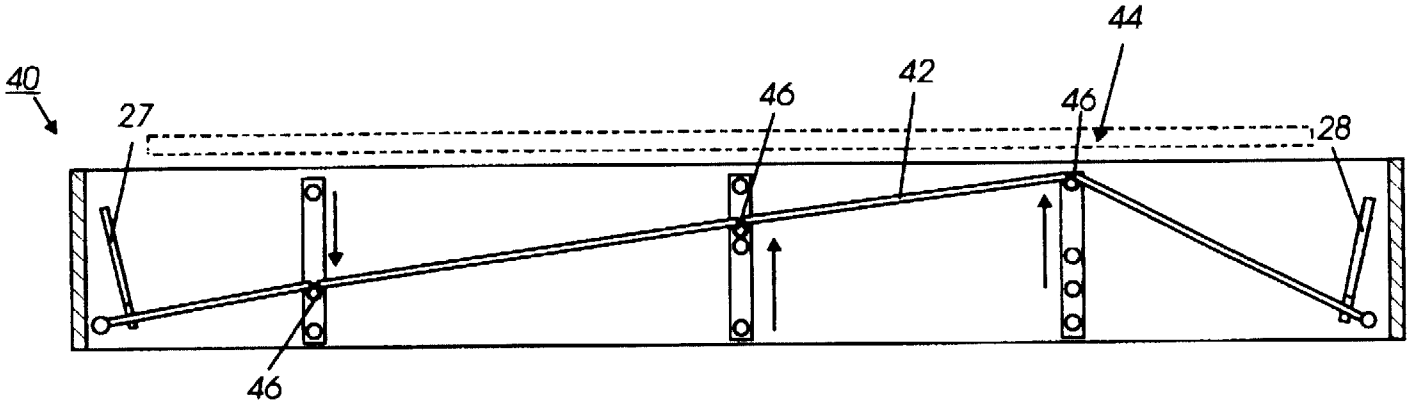
Figure 10D:
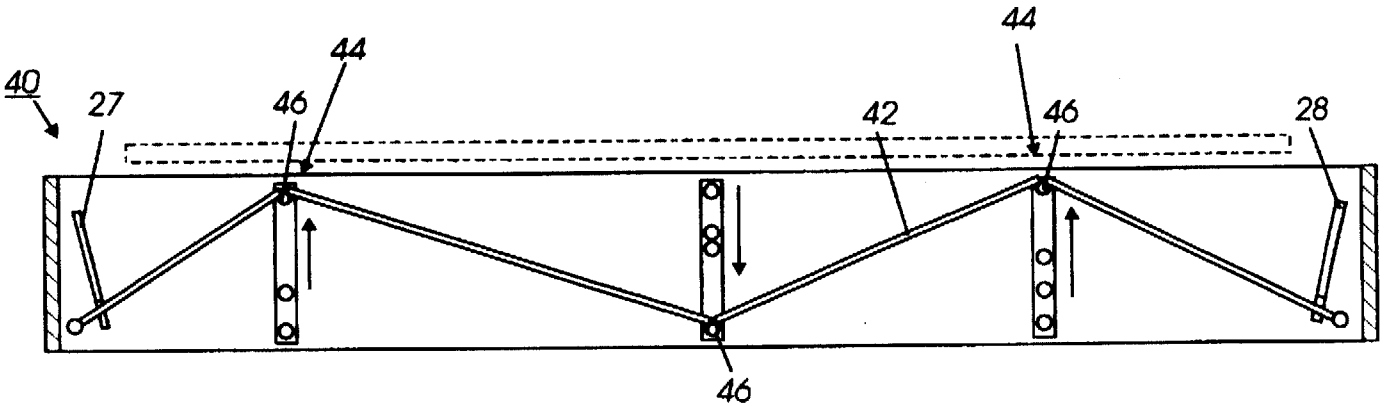
Figure 11:
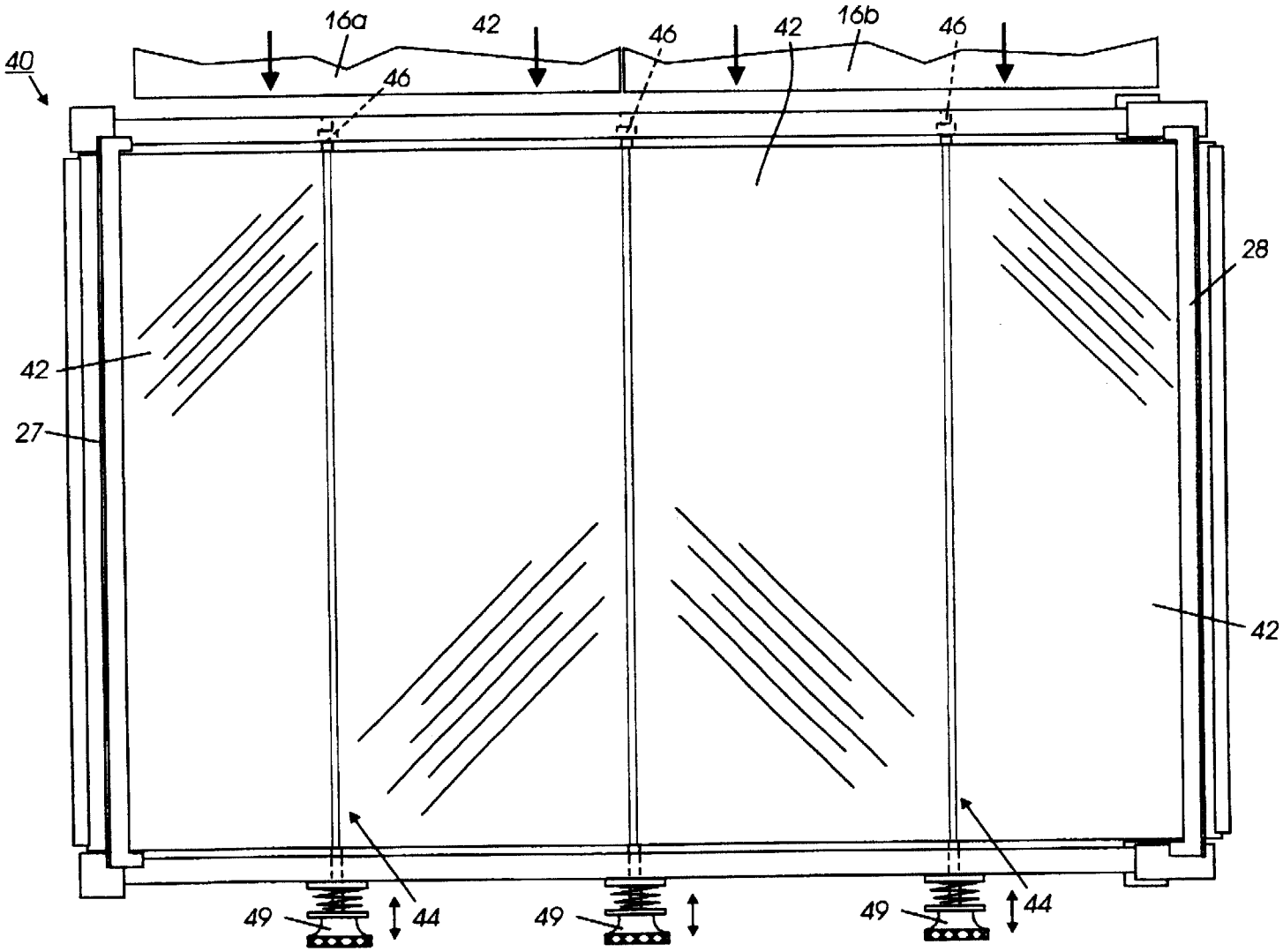
FIG. 11 is a top view of FIG. 10.

Turning now to the plural mode special stacking tray systems disclosed herein, as noted, four examples are illustrated: output sheet stacking tray system 20 of FIGS. 5, 6, and 7, an alternative stacking tray system embodiment 30 of FIGS. 8 and 9; a third embodiment of FIGS. 10 and 11, and a fourth embodiment in FIG. 12. All of these sheet stacking tray systems are selectably convertible between a single sheet stacking position surface mode and a plural slit sheet stacking surface mode wherein plural sheet stacking surfaces of variable areas can be provided. These stacking areas can be selectably variable in coordination with the selection of the sheet slitting position to provide separate stacking of the separated slit sheets on respective sheet stacking surfaces. For separating the slit sheets, these different sheet surfaces are preferably opposingly transversely sloped as shown, and have low friction surfaces to assist the slit sheets to slide laterally away from one another for separate stacking, even though they are slit from the same printed sheet and thus initially directly adjacent one another as they exit.

This tray separation of the slit sheets along their slitting lines is preferably provided by having the opposingly sloped surfaces intersect substantially in line with the slitting positions of the slitter. To express it another way, there is desirably provided a roof-shaped surface on or in the stacking tray in which there is a repositionable roof ridge line extending in the sheet output direction from the slitting position of the slitter.

This should not be confused with prior art fan-fold continuous web stacking trays with raised central portions extending transversely of the sheet output direction so as to cause the fan-fold web to fold arcuately thereover for improved fan-fold stacking. That is, of course, a different orientation and a different function.

Referring now in more detail to the plural mode stacking tray system 20 of FIGS. 5–7, in this system the tray stacking surface is a flexible web member 22, such as a plastic or elastomer member with a low friction surface coating. As shown particularly in FIG. 7, this tray stacking surface; 22 is readily separable into two separate, oppositely sloping sheet stacking surface sections 22*a*, 22*b*. These stacking surfaces are variable in size and position, as will be described in connection with FIGS. 5*a*, 5*b*, and 5*c*. These surfaces intersect at a roof ridge line 23 forming the apex or separating line therebetween. That roof ridge line 23 is defined here by an underlying bail bar 24 extending up above the base of the tray and extending away from the slitter 14. The bail bar 24 is movable laterally with a lateral position adjusting system, here comprising slide rails 26*a* and 26*b* on which the bail bar is vertically mounted, but slidable laterally such as by the lateral position adjuster 25 shown in FIG. 7 and held in position by set a bail bar locking position system screws or knobs, as shown. An exploded partial cut-away view is shown of a bail bar locking position system 29 at the outer end of the tray at FIG. 7.

Referring now to the three different operating positions of this system 20 shown in FIGS. 5*a*, 5*b*, and 5*c* respectively, it may be seen that the position of FIG. 5*a* also corresponds to the top view of FIG. 6 and the perspective view of FIG. 7. Namely, the bail bar 24 being centered here to separate a center slit sheet into two separate stacking surface sections 22*a*, 22*b*. FIG. 5*b* shows the bail bar 24 moved all the way to the left to provide a single large stacking surface 22*b* on which either unslit sheets can all be stacked to one side of the tray or, alternatively, a banner strip or other edge trimming may be cut off by the slitter and collected on the small area 22*a* to the left of the ridge line position 23. FIG. 5*c* is similar to FIG. 5*b* except that here the surface is oppositely sloped by moving the bail bar 23 to the opposite side of the tray. In all these cases, the edge registration can be provided by conventional substantially vertical edge stacking walls 27 and 28 at opposite sides of the tray.

Turning now to the alternative tray system embodiment 30 of FIG. 8 and 9, here, instead of a flexible tray stacking surface 22 as in the previous embodiment, the stacking surfaces are provided by a plurally hinged tray stacking surface 32, which is hinged along hinge lines by hinges 33, which may be variably lifted into the desired operating position by rotating lifters 35 selectively respectively locked in place by associated knobs 39 as shown in FIG. 9. Here, since the roof ridge line is not continuously variable, the hinge lines are selected to correspond to preselected slitting positions of the slitter 14.

Turning now to the third embodiment 40 of FIGS. 10 and 11, here the tray stacking surface 42 has an integral plastic member with molded in hinge positions such as is well known to be manufacturable in polypropylene or the like. These molded-in hinges 44 are vertically resettable by vertically variable reset position members, such as the illustrated pins or shafts 46 through the hinges which are resettable and retained in preset or desired vertical positions, such as by the spring loaded and knobs 49 illustrated in the top view of FIG. 11.

It may be seen that the roof line, bail bar, hinge line or other surface defining member of these various examples causes the tray to take the shape of an inverted "V". This causes the portions of the incoming slit sheets to slide away from one another transversely, respectively outwardly toward their opposing registration walls 27 and 28, so that they separately stack. If desired, this may be enhanced by an extra, underlying, tray surface as in FIG. 12, such that after the sheets have been so laterally separated, they would drop on top of previous sheets on the underlying tray for more even stacking. Irrespective of the slitting position, it may be seen that the peak or roof line of the stacking tray slope separation lines up with the slitting position in the sheets. When slitting is not utilized, the peak or roof line may be removed or moved to one side of the tray to provide a simple single sloped surface instead of an inverted "V" shape. Thus, compatible conventional stacking of unslit sheets can be provided in the same stacking tray.

To ensure unobstructed stacking, stiff paper and/or sheet exit corrugation may be desirable, so that the slit sheets extend out substantially over the previously stacked slit sheets before they drop onto their respective stacks. Alternatively, a system such as 60 in FIG. 12 may be used for supporting the slit sheets up above the top of the stacks until they have already substantially laterally separated and are moving laterally towards the lateral stacking registration walls, after having been released by the exit rollers/cutters nip.

Figure 12A:
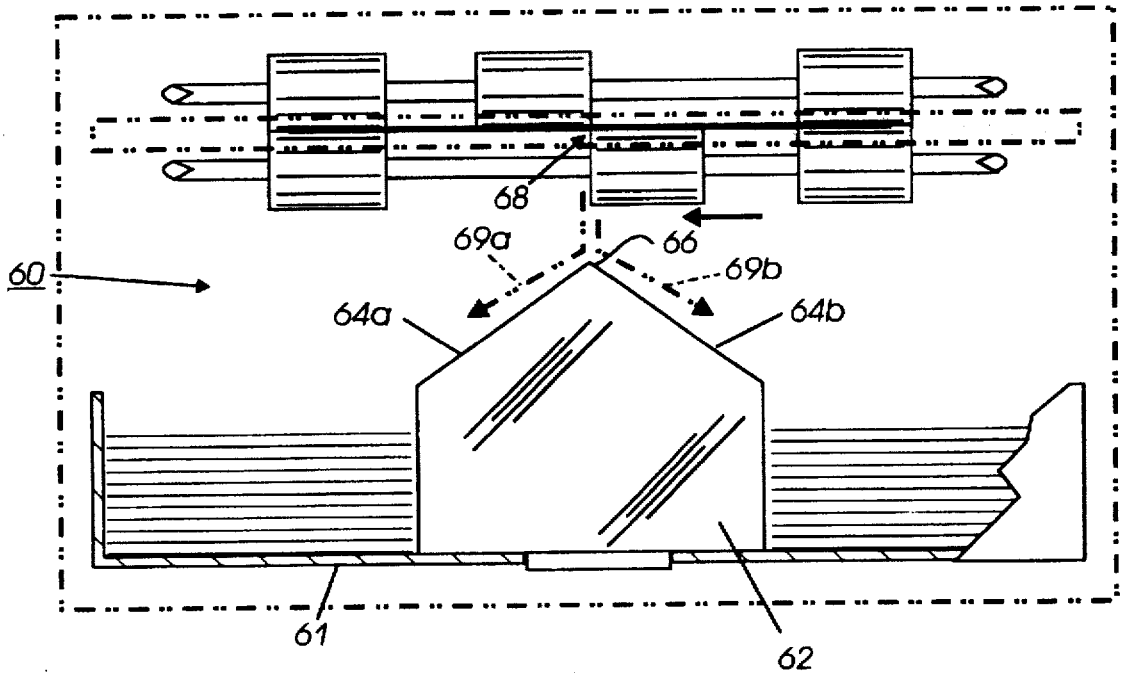
FIGS. 12*a* and 12*b* are a fourth embodiment with roof separating surfaces spaced above the stacking tray, for separate stacking of slit sheets, which is provided by a unit which is removable as in FIG. 12*b* for uncut sheets stacking.
Figure 12B:
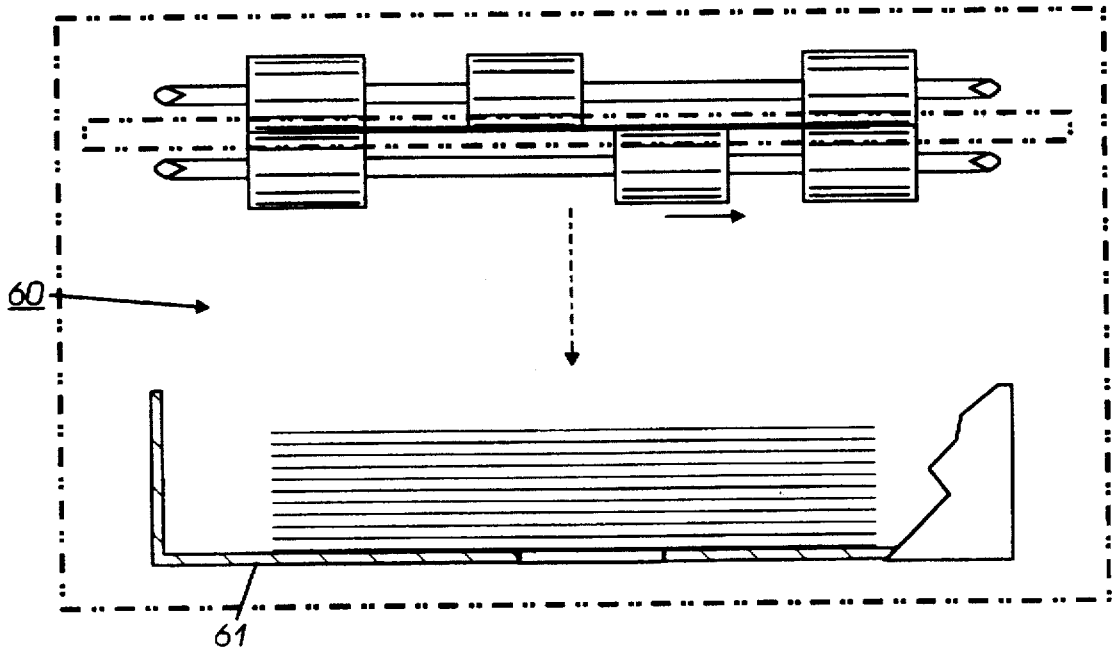

FIG. 12A illustrates an example of such a double or separate tray surfaces system in which the sheet being slit at 68 by slitter rolls, as shown by movement arrows 69*a*, 69*b*, drops down and then is laterally separated on the opposing slopes 64*a*, 64*b* of a hollow separate roof surface unit 62 which is provided by roof surfaces 64*a*, 64*b* spaced above the stacking tray 61 so that the sheets will stack more readily on top of one another at the opposite sides of the tray, as shown. This separating roof member unit 62 can be laterally repositioned as described above for different slitting positions, and can be completely removed by lifting off of tray 61 for uncut sheet stacking as in FIG. 12B.

It is also noted that the output tray systems here could be utilized as a document output tray to separate document sheets which are being fed side by side in pairs by the document handler from the document imaging platen. This same lateral separation into two separate stacks could be provided for that application as well.

While the embodiments disclosed herein are preferred, it will be appreciated from this teaching that various alternatives, modifications, variations or improvements therein may be made by those skilled in the art, which are intended to be encompassed by the following claims:

We claim:

1. In a reproduction system with an output system having an output sheet stacking tray system, said output system further having a slitter with selectable sheet slitting positions in which printed sheets being outputted by said reproduction system into said output system are selectably unslit or slit in their sheet output direction by said slitter into plural slit sheets of selectably variable sheet widths and stacked in said output sheet stacking tray system, which output sheet stacking tray system includes a sheet stacking surface member; the improvement comprising:

said sheet stacking surface member being flexible for selective repositioning into plural sheet stacking sections having plural differently angled sheet stacking surfaces, said output sheet stacking tray system further including a repositionable support system supporting said sheet stacking surface member for selectively forming said differently angled sheet stacking surfaces to provide a dual mode output sheet stacking tray system which is selectably convertible between a single sheet stacking position surface mode, wherein said sheet stacking surface is substantially planer for stacking unslit sheets thereon, and a plural slit sheet stacking surfaces mode wherein said sheet stacking surface is repositioned by said repositional support system into said plural sheet stacking sections having said plural differently angled sheet stacking surfaces, wherein in said plural slit sheet stacking surfaces mode said output sheet stacking tray system selectively provides plural said sheet stacking surfaces which are selectably variable in width for cooperation with the selectable sheet slitting position slitter to provide separate stacking of said plural slit sheets on respective said plural sheet stacking surfaces;

wherein said repositionable support system comprises a bial bar extending longitudinally under and supporting said flexible sheet stacking surface member, and wherein said bail bar is movably mounted for movement in a transverse direction for alignment with said selectable sheet slitting positions.

* * * * *